US005981409A

United States Patent [19]

Takagi et al.

[11] Patent Number: 5,981,409

[45] Date of Patent: Nov. 9, 1999

[54] FABRIC FOR DUST- AND WATERPROOF CLOTHES

[75] Inventors: Susumu Takagi; Yutaka Matsui, both of Fukui, Japan

[73] Assignee: Seiren Co., Ltd., Fukui, Japan

[21] Appl. No.: 09/216,297

[22] Filed: Dec. 18, 1998

[30] Foreign Application Priority Data

Dec. 18, 1997 [JP] Japan ..... 9-349012

[51] Int. Cl.[6] ..... D03D 15/00

[52] U.S. Cl. ..... 442/203; 139/420 A; 2/901

[58] Field of Search ..... 442/203; 139/420 A; 2/901

[56] References Cited

FOREIGN PATENT DOCUMENTS 60-259649 12/1985 Japan .

1-321904 12/1989 Japan .

*Primary Examiner*—Christopher Raimund

*Attorney, Agent, or Firm*—Dilworth & Barrese

[57] ABSTRACT

A fabric is provided which exhibits a high dust collecting efficiency and which is superior in both waterproofness and abrasion resistance, and which is especially suitable for us in dust proof and/or waterproof clothes.

The fabric is a plain weave fabric of synthetic filaments, wherein warp yarns occupy 60% to 90% of the fabric surface, a percent (%) overlap of the width (L2+L3) of overlapped portions of adjacent warp yarns relative to the width (L1) of an overlapped portion of adjacent warp yarns in a section of the fabric, i.e., ((L2+L3)/L1)×100 is in the range of 35% to 60%, and weft yarns of the fabric are located inside the warps in the thickness direction of the fabric.

20 Claims, 1 Drawing Sheet

FABRIC FOR DUST- AND WATERPROOF CLOTHES

FIELD OF THE INVENTION

The present invention relates to a fabric which exhibits a high dust filtrating efficiency and which is superior in both waterproofness and abrasion resistance, and which is especially suitable for use in dust proof and/or waterproof clothes.

BACKGROUND OF THE INVENTION

The recent progress of the semiconductor manufacturing technique is outstanding, which technique is becoming more and more fine. With this tendency, there is an increasing demand for a higher degree of cleanness of the air present in a clean room as a semiconductor manufacturing site. As to suspended dust in the clean room, a target degree of cleanness is substantially attained by a facility improvement using an appropriate filter and taking the circulation of air in the clean room into account. As the material of dust proof clothes used in the clean room there is used a woven or non-woven fabric of synthetic filaments to prevent the generation of dust from the dust proof clothes. Further, as the material of dust proof clothes there also has been used fabric composed of polyester yarns and electrically conductive yarns, or a fabric subject to an antistatic finishing, to prevent dust from adhering to the dust proof clothes.

However, it has turned out that when a man works in a working space which is very strict against residual suspended dust, the worker himself or herself or the worker's undershirt is the main cause of dust generation. Thus, there exists a demand for preventing the leakage of dust generated inside the dust proof clothes to the exterior of the clothes. Although a large number of clothes called dust proof clothes have heretofore been available commercially, many of them use electrically conductive yarn as antistatic measures woven into the clothes to prevent the adhesion of dust to the clothes, or have been subjected to an antistatic finishing. In such dust proof clothes, the cuff and neck are closed with rubber or the like to prevent the leakage of dust generated from the worker's skin and undershirt through the cuff and neck. They are measures against static electricity and leakage of dust, but they are insufficient for preventing dust permeation therethrough.

For remedying the above-mentioned points, an attempt of using, for dust proof clothes, a laminate structure of woven and non-woven fabrics of filaments is described in JP60-34606A and 61-55204A.

Further, in JP60-34605A, 61-55205A and 61-75804A are described fabric-polymer laminate structures such as, for example, a synthetic filament fabric and a soft resin coated on or laminated to the surface of the fabric. Dust proof clothes of the resin laminated type are moisture-permeable because there is used a moisture-permeable waterproof resin, but the air permeability thereof is poor, so when the clothes are used over a long time, the inside of the clothes becomes stuffy, thus giving an unpleasant feeling to the person who wears the clothes. Moreover, due to a low air permeability of the fabric, there occurs the problem of dust leakage from a cuff or a neck by a pumping effect as the wearer moves. Further, because the laminated resin is inferior in abrasion resistance, the resin comes off and its performance is deteriorated after repeated wearing and washing.

The use of a multifilament yarn in the contituent filament not larger than 1.5 denier is described in JP60-259649A end JP1-321904A. Although the use of such in constituent very fine filaments is advantageous in point of improving the filtration efficiency, the use of yarns in constituent very fine filaments is not always advisable because a decrease of the constituent filament size causes deterioration of abrasion resistance or of tear strength.

Heretofore, as fabrics for dust proof clothes, both plain weave fabric and twill fabric have been used generally. Plain weave fabric is superior in abrasion resistance because there are few floating threads, but it is difficult to eliminate pores formed at intersecting portions of weaving yarns and therefore the dust filtration efficiency of plain weave fabric is inferior to that of twill fabric. As to the twill fabric, it is possible to diminish such inter-yarn pore at the point of intersection of warp yarn and weft yarn and the dust filtration efficiency thereof is generally superior to that of the plain weave fabric, but there occur a lot of floating threads, which is attributable to the weave of the twill fabric. Thus, the abrasion resistance is generally infereior to that of plain weave fabric.

Keeping the air permeability of these fabrics low is effective in preventing dust from passing through the fabrics, and high-density fabrics have so far been developed for keeping the fabric air permeability low. However, a limit is encountered in increasing the weave density of fabric, and weaving encounters a limit in diminishing the inter-yarn pore size at the point of intersection of warp yarn and weft yarn. Therefore, the fabric is subjected to shrinking in a finishing process to enhance the fabric weave density. The high-density fabric thus prepared is further subjected to calendering with use of hot pressure rolls to crush the fabric, thereby diminishing the voids present at intersecting portions of weaving yarns and enhancing the dust filtration efficiency. However, as a higher degree of cleanness in cleanroom is requested, by merely finishing a general fabric using yarns in constituent very fine filaments, it is no longer possible to meet the demand for a high dust filtering performance.

For obtaining waterproof fabrics, various attempts have been made heretofore.

According to one conventional method, a waterproof membrance is laminated to a fabric by, for example, coating or laminating to afford a waterproof composite. This method is commonly adopted and such a composite waterproof fabric is in mass production, but there remains a problem to be solved in point of comfortability because the fabric is poor in air permeability and is apt to become stuffy. There also is a problem of high cost.

According to another conventional method, waterproofness is attained without using such a waterproof membrance as is formed by coating or lamination. In this method, a high-density fabric is woven using yarns in constituent very fine filaments as at least one of warp yarn and weft yarn, which subsequent calendering with use of not pressure rolls to crush the fabric and thereby diminish pore size present at intersecting portions of weaving yarns.

Although the method just referred to above is advantageous to the improvement of waterproofness because it uses yarns in constituent very fine filaments, the use of yarns in constituents very fine filaments is not always advisable because a decrease of the constituent filament size causes deterioration of abrasion resistance or of tear strength.

OBJECTS OF THE INVENTION

It is an object of the present invention to solve the above-mentioned problems of the prior art and provide a fabric superior in all of dust filtration efficiency, waterproofness and abrasion resistance.

SUMMARY OF THE INVENTIONS

The present invention resides in a plain weave fabric comprising synthetic filaments, in which 60% to 90% of the fabric surface is occupied by warps and, in a section of the fabric, a percent overlap $((L2+L3)/L1)\times 100$ of the width (L2+L3) of overlapped portions of adjacent warps relative to the width (L1) of an overlapped portion of adjacent warp yarns is in the range of 35% to 60%, weft yarns of the fabric being located inside in the thickness direction of the fabric.

DETAILED DESCRIPTION OF THE INVENTION

The first feature of the present invention resides in enhancing the warp density of a plain weave fabric to diminish gaps present between warp yarns. According to this feature, warp yarns occupy 60% to 90%, preferably 70% to 80%, of the fabric surface so that weft yarns area located inside in the fabric thickness direction. Since weft yarns do not appear on the fabric surface, finished yarn which is disadvantageous to abrasion resistance, is employable as weft yarn. Further, the use of finished yarn permits a fabric to be obtained which is superior in dyeing and finishing characteristics, also superior hand and comfotableness in wearing.

As shown in FIG. 1, adjacent warp yarns partially overlap each other to form, in a sectional view, a three-layer structure of fabric consisting of warp—weft—warp. In a section of the fabric, a percent overlap of the width (L2+L3) of overlapped portions of adjacent warp yarns relative to the width (L1) of an overlapped portion of adjacent warp yarns is in the range of 35% to 60%, preferably 40% to 50%. In such a structure there is no inter-yarn pore in superficial observation. Even when viewed in three-dimensional observation, the structure is made fine up to a degree of 10 $\mu$m or so.

Pores formed in a fabric are classified into inter-fiber pore in warp yarn and weft yarn and inter-yarn pore at the point of intersection of warp yarn and weft yarn. Generally, in the case where dust and water pass through a fabric, the larger the size of pore extending through the fabric, the easier the passage of dust and water therethrough. Thus, it is important to reduce the size of each pore extending through the fabric. Of the aforesaid pores, the largest-pore in diamter is the inter-yarn pore at the point of intersection of warp yarn and weft yarn. Diminishing the inter-yarn pore at the point of intersection of warp yarn and weft yarn is effective in preventing the leakage of dust and in improving the waterproofness. The present invention is based on the study of this point.

The use of a multiflament yarn using very fine filaments is advantageous to the prevention of dust passage and improvement of waterproofness, but the use of a multifilament yarn of a fine constituent filament size is not always advisable because the abrasion resistance or tear strength will be deteriorated.

The fabric of the present invention is obtained by weaving a multifilament yarn, not a very fine filament, to as high a density as possible. The thus-woven fabric is then subjected to such finishing steps as scouring, heat setting, dyeing and calendering with use of hot pressure rolls in accordance with known methods. It is not always necessary to go through all of these finishing steps. Some of them may be omitted as the case may be. By allowing the fabric to shrink largely through the scouring, heat setting and dyeing steps, there can be obtained a fabric of high density.

Calendering with hot pressure rolls is a known method for diminishing inter-yarn pore at the point of intersection of warp yarn and weft yarn and thereby decreasing air permeability and waterproofness. It goes without saying that suitable finishing conditions may be selected so as to derive a predetermined performance.

In order to obtain such a three-layer structure as shown in FIG. 1 wherein adjacent warps of a plain weave fabric overlap each other, it is absolutely necessary to not only control weaving but also maximize the density of a textile product obtained and control the shape of textile. For attaining this structure it is important that the relation between weave density and yarn denier satisfy the following indexes ①, ② and ③ with respect to each of warp yarns and weft yarns:

① $2300 \leqq \text{warp density} \times \sqrt{\text{warp yarn denier}} + \text{weft density} \times \sqrt{\text{weft yarn denier}} \leqq 2500$ ② $1500 \leqq \text{warp density} \times \sqrt{\text{warp yarn denier}} \leqq 1600$ ③ $800 \leqq \text{weft density} \times \sqrt{\text{weft yarn deniers}} \leqq 900$ The warp density and weft density are represented in pc./in. The index ① shows the range of cover factor.

As shown in FIG. 2, the ratio of a maximum width L1 to a minimum width L0 of a single warp exposed to the fabric surface should satisfy the condition of $L1/L0 \geqq 1$. If the ratio L1/L0 is too large, the wearing comfortability is impeded and therefore L1/L0 should be in the range of $2.0 \geqq L1/L0 \geqq 1.5$, preferably $1.9 \geqq L1/L0 \geqq 1.6$. Within this range, there is formed an appropriate overlap between adjacent warps. By providing such an overlapped portion, there is obtained a structure wherein the pores between adjacent yarns in the fabric are diminished.

According to this structure, the opportunity of contacting dust particles with the filaments during passage between yarns increases, thereby the filtration effect of the dust proof fabric and the waterproofing effect of the waterproof fabric are also improved.

Besides, since the floating of weft is prevented by enhancing the weave density of warp, the use of a warp yarn superior in abrasion resistance makes it possible to protect weft yarn and enhance the abrasion resistance of fabric. As a result, it becomes possible to use as weft finished yarn advantageous in point of hand and finishability.

The above structure in the present invention permits the use of a filament not smaller than 2 denier which filament is difficult to break and is superior in abrasion resistance while retaining the dust filtrating efficiency and waterproofness at a high level, there being no need of specially using a very fine filament. Therefore, even if yarns are restrained by calendering using hot pressure rolls, it is possible to minimize the decrease in tear strength.

Also in point of the hand of fabric it is preferable that the filament denier be not larger than 5 denier even at a maximum.

As to the yarn denier used in the present invention, the range of 50 to 450 denier is preferred not only for attaining high dust filtration efficiency and waterproofness but also in point of application to clothes.

In the case where the fabric of the invention is to be applied to dust proof clothes, it is desirable to use a synthetic filament as a constituent filament of the fabric to suppress the generation of dust from the dust proof clothes. Further, in point of hand, it is desirable to use a polyester yarn as warp and a finished polyester yarn as weft.

The fabric of the invention may be used for the whole of dust proof clothes or it may be used as part of the clothes such as the back portion, elbow portions, or knee portions. As dust proof clothes using the fabric of the invention there are included not only those which are used directly as outer garments but also auxiliary dust proof clothes used as inner clothes inside the dust proof clothes to improve the dust proofing characteristic of the outside dust proof clothes and also improve the comfortableness in wearing and easiness of motion.

When using the fabric of the present invention as a waterproof cloth, it can be subjected to a conventional water repellent finish to obtain a highly waterproof fabric.

Usually, in conventional waterproof fabrics having no waterproof membrance or laminate layer, those from ultrafine fibers are inferior in physical properties such as strength and abrasion resistance, and those from thick fibers of which single fiber denier is higher than 2 deniers are inferior in waterproofness required in waterproof fabrics.

Contrast thereto, the waterproof fabric of the present invention has superior waterproofness, gas permeability, strength, durability and other properties and exhibits good performances as waterproof clothes. Moreover, the fabric of the present invention exhibits superior dust filtration efficiency and can be used as dust proof and waterproof clothes.

EXAMPLES

Performance characteristics were determined by the following methods.

① Percent Dust Filtration

Determined within a room air-conditioned to a temperature of 20° C. and a humidity of 65% in which there is little variation in dust density and dust particle size distribution in air.

A fabric sample is attached to a funnel having an effective diameter of 5.5 cm so as to prevent the leakage of air and a particle counter (KC-01A type, manufactured by Rion Co.) is operated through a conduit of the funnel (sample air suction: 0.5 L/min) to such the air filtered by the fabric into the particle counter and the number (n) of dusts having sucked particle diameter of 0.3 μm to 0.5 μm is measured. At this time, the number ($n_0$) of sucked background dust particles ranging in diameter from 0.3 to 0.5 μm is measured separately. Percent dust filtration efficiency (H%) was culculated in accordance with the following equation:

$$H(\%)=(n_0-n)/n_0\times 100$$

Given that the counter suction is 0.5 L/min, the filtration rate is 0.35 cm/sec.

② Air Permeability

Determined by the Fragile method defined in JIS L 1096.

③ Thickness

Determined according to JIS L 1079.

④ Water Repellency

Determined according to JIS L 1092.

⑤ Resistance to Water Pressure

Determined according to JIS L 1092.

⑥ Tear Strength

Determined according to JIS L 1096.

Example 1

A plain weave fabric using a polyester yarn 75D-36F as warp and a polyester finished yarn 75D-36F as weft was scoured, dried and then subjected to shrinking by a setter at 200° C. The warp density was 221/inch and the weft density was 98/inch. Then the fabric was finished by calendering with hot pressure rolls at 180° C. and pressure of 200 kg/cm. Performance characteristics of the fabric thus finished are shown in Table 1.

Example 2

A plain weave fabric using a polyester yarn 50D-24F as warp and a polyester finished yarn 50D-24F as weft was scoured, dried and then subjected to shrinking by a setter at 200° C. The warp density was 221/inch and the weft density was 120/inch. Then the fabric was finished by calendering with hot pressure rolls at 180° C. and pressure of 200 kg/cm. Performance characteristics of the fabric thus finished are shown in Table 1.

Comparative Example 1

A plain weave fabric using a polyester yarn 75D-68F as warp and a polyester finished yarn 75D-68F as weft was scoured, dried and then subjected to shrinking by a setter at 200° C. The warp density was 170/inch and the weft density was 90/inch. Then the fabric was finished by calendering with hot pressure rolls at 180° C. and pressure of 200 kg/cm. Performance characteristics of the fabric thus finished are shown in Table 1.

Comparative Example 2

A plain weave fabric using a polyester yarn 150D-72F as warp and a polyester finished yarn 15OD-48F as weft was scoured, dried and then subjected to shrinking by a setter at 200° C. The warp density was 90/inch and the weft density was 72/inch. Then the fabric was finished by calendering with hot pressure rolls at 180° C. and pressure of 200 kg/cm. Performance characteristics of the fabric thus finished are shown in Table 1.

Comparative Example 3

The fabric of Comparative Example 2 was coated with a urethane resin by a wet coagulation method. Performance characteristics of the fabric thus coated are shown in Table 1.

Example 3

A plain weave fabric using a polyester yarn 75D-36F as warp and a polyester finished yarn 75D-36F as weft was scoured, dried and then subjected to shrinking by a setter at 200° C. The warp density was 181/inch and the weft density was 98/inch. Then the fabric was immersed in an apparent 5% aqueous dispersion of Asahi Guard LS317 (manufactured Asahi Glass Co., fluoric water repellent), squeezed with mangles, thereafter dried and heat-treated at 150° C. for 1 minute. The fabric thus treated was then finished by calendering with hot pressure rolls at 180° C. and pressure of 200 kg/cm. Performance characteristics of the fabric thus finished are shown in Table 1.

Example 4

A plain weave fabric using a polyester yarn 50D-24F as warp and a polyester finished yarn 50D-24F as weft was scoured, dried and then subjected to shrinking by a setter at 200° C. The warp density was 221/inch and the weft density was 120/inch. Then the fabric was subjected to water repellent finishing in the same manner as in Example 3 and was then finished by calendering with hot pressure rolls in the same manner as in Example 3. Performance characteristics of the fabric thus finished are set forth in Table 1.

Comparative Example 4

A plain weave fabric using a polyester yarn 75D-68F as warp and a polyester finished yarn 75D-68F as weft was scoured, dried and then subjected to shrinking by a setter at 200° C. The warp density was 170/inch and the weft density was 90/inch. Then the fabric was subjected to water repellent finishing in the same manner as in Example 3 and was thereafter finished by calendering with hot pressure rolls in the same manner as in Example 3. Performance characteristics of the fabric thus finished are set forth in Table 1.

Comparative Example 5

A plain weave fabric using a polyester yarn 150D-72F as warp and a polyester finished yarn 150D-48F as weft was scoured, dried and then subjected to shrinking by a setter at 200° C. The warp density was 90/inch and the weft density was 72/inch. Then the fabric was subjected to water repellent finishing in the same manner as in Example 3 and was thereafter finished by calendering with hot pressure rolls in the same manner as in Example 3. Performance characteristics of the fabric thus finished are set forth in Table 1.

In the Table, Index ① is the value of the equation: warp density×$\sqrt{\text{warp yarn denier}}$+weft density×$\sqrt{\text{weft yarn denier}}$, Index ② is the value of the equation: warp density×$\sqrt{\text{warp yarn denier}}$ and Index ③ is the value of the equation: weft density×$\sqrt{\text{weft yarn denier}}$.

TABLE 1

(1)

| Yarn | Warp Weft | Example 1 PET 75D-36F PET 75D-36F Finished Yarn | Example 2 PET 50D-24F PET 50D-24F Finished Yarn | Comparative Example 1 PET 75D-68F PET 75D-68F Finished Yarn | Comparative Example 2 PET 150D-72F PET 150D-48F Finished Yarn | Comparative Example 3 PET 150D-72F PET 150D-48F Finished Yarn |
|---|---|---|---|---|---|---|
| Density (pc/in) | Warp | 181 | 221 | 170 | 90 | 90 |
| | Weft | 98 | 120 | 90 | 72 | 72 |
| Weight (g/m$^2$) | | 104 | 85 | 90 | 123 | 143 |
| Thickness ($\mu$m) | | 150 | 120 | 90 | 150 | 160 |
| Percent Dust Collection (5) | | 72 | 60 | 50 | 30 | 60 |
| Water Repellency (JIS L-1092) | | — | — | — | — | — |
| Resistance to Water Pressure (JIS L-1092) | | — | — | — | — | — |
| Air Permeability (cc/cm2/sec) | | 1.0 | 1.0 | 0.1 | 3.5 | 0.1 |
| Abrasion* Resistance (class) | | 4 | 4 | 2 | 4 | 4 |
| Percent Occupancy of Surface Warp (%) | | 75 | 75 | 64 | 46 | 46 |
| Percent Overlap of Warps (%) | | 44 | 43 | 31 | 0 | 0 |
| Index ② | | 1568 | 1563 | 1472 | 779 | 779 |
| Index ③ | | 849 | 849 | 779 | 882 | 882 |
| Index ① | | 2417 | 2412 | 2251 | 1661 | 1661 |
| W1/W0 | | 1.79 | 1.75 | 1.45 | 1.00 | 1.00 |
| Tear Strength (kgf) | length | 2.90 | 2.40 | 1.43 | 3.10 | 2.90 |
| | width | 1.34 | 1.20 | 0.72 | 2.10 | 1.90 |
| Exposure of weft to the fabric surface | | no | no | yes | yes | yes |

TABLE 1

(2)

| Yarn | Warp Weft | Example 3 PET 75D-36F PET 75D-36F Finished Yarn | Example 4 PET 50D-24F PET-50D-24F Finished Yarn | Comparative Example 4 PET 75D-68F PET 75D-68F Finished Yarn | Comparative Example 5 PET 150D-72F PET 150D-48F Finished Yarn |
|---|---|---|---|---|---|
| Density (pc/in) | Warp | 181 | 221 | 170 | 90 |
| | Weft | 98 | 120 | 90 | 72 |
| Weight (g/m$^2$) | | 104 | 85 | 90 | 123 |
| Thickness ($\mu$m) | | 150 | 120 | 90 | 150 |
| Percent Dust Filtration (%) | | 70 | 59 | 45 | 27 |
| Water Repellency (JIS L-1092) | | 90 | 90 | 90 | 90 |
| Resistance to Water Pressure (JIS L-1092) | | 900 | 900 | 800 | 200 |
| Air Permeability (cc/cm$^2$/sec) | | 1.0 | 1.0 | 0.1 | 3.5 |
| Abrasion | | 4 | 4 | 2 | 4 |

TABLE 1-continued (2)

| Yarn | Warp<br>Weft | Example 3<br>PET 75D-36F<br>PET 75D-36F<br>Finished Yarn | Example 4<br>PET 50D-24F<br>PET-50D-24F<br>Finished Yarn | Comparative Example 4<br>PET 75D-68F<br>PET 75D-68F<br>Finished Yarn | Comparative Example 5<br>PET 150D-72F<br>PET 150D-48F<br>Finished Yarn |
|---|---|---|---|---|---|
| Resistance (class) | | | | | |
| Percent Occupancy of Surface Warp (%) | | 75 | 75 | 64 | 46 |
| Percent Overlap of Warps (%) | | 44 | 43 | 31 | 0 |
| Index ② | | 1568 | 1563 | 1472 | 779 |
| Index ③ | | 849 | 849 | 779 | 882 |
| Index ① | | 2417 | 2412 | 2251 | 1661 |
| W1/W0 | | 1.79 | 1.75 | 1.45 | 1.00 |
| Tear Strength (kgf) | length | 2.90 | 2.40 | 1.43 | 3.10 |
| | width | 1.34 | 1.20 | 0.72 | 2.10 |
| Exposure of weft to the fabric surface | | no | no | yes | yes |

EFFECT OF THE INVENTION

Figure 1:
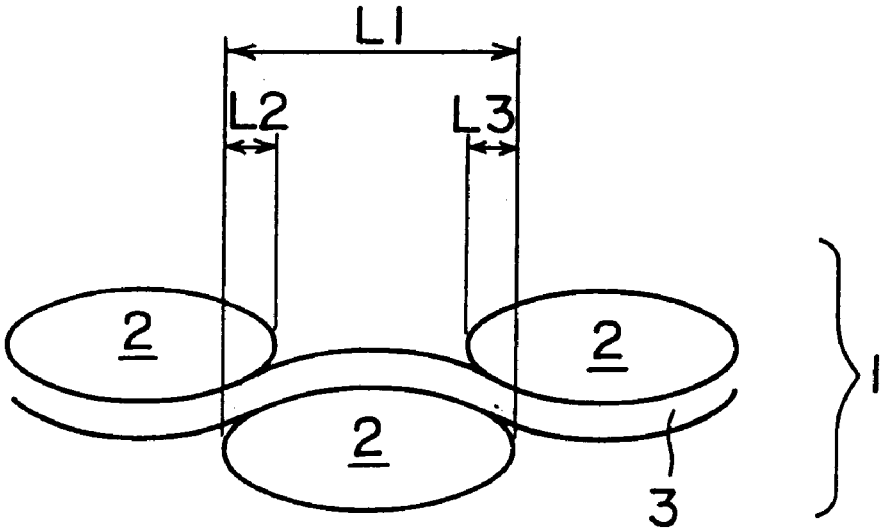
FIG. 1 is a schematic diagram showing a sectional structure of a fabric according to the present invention.
Figure 2:
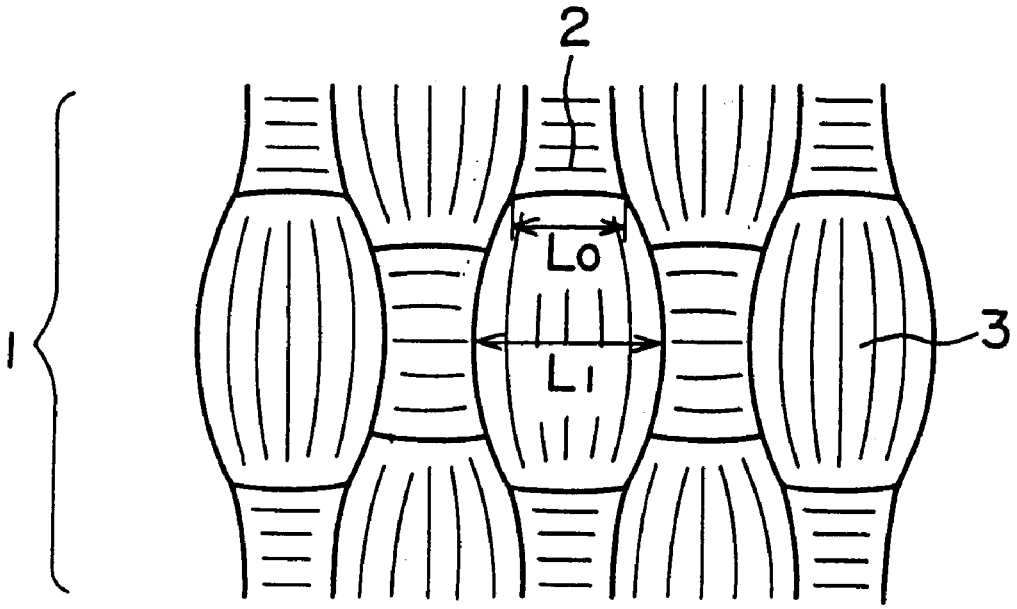
FIG. 2 is a schematic front view thereof.

According to the structure of the present invention there can be provided dust proof clothes superior in all of dust filtration efficiency, waterproofness, even without using yarns in constituent very fine filaments. Besides, since the fabric of the invention is a woven fabric using filaments, there is little dust generated from the fabric itself. Further, since microfine denier fiber are not used, the abrasion resistance, washing resistance and wearing resistance of the fabric is high.

What is claimed is:

1. A fabric constituted by a plain weave fabric of synthetic filaments, wherein warps occupy 60% to 90% of the fabric surface, a percent (%) overlap of the width (L2+L3) of overlapped portions of adjacent warps relative to the width (L1) of an overlapped portion of adjacent warps in a section of the fabric, ((L2+L3)/L1)×100) is in the range of 35% to 60%, and wefts of the fabric are located inside in the thickness direction of the fabric.

2. A fabric as set forth in claim 1, wherein the relation between weave density and total filament size satisfies the following indexes ①, ② and ③ with respect to each of the warps and wefts of the plain weave fabric:

① $2300 \leqq \text{warp density} \times \sqrt{\text{warp yarn denier}} + \text{weft density} \times \sqrt{\text{weft yarn denier}} \leqq 2500$ ② $1500 \leqq \text{warp density} \times \sqrt{\text{warp yarn denier}} \leqq 1600$ ③ $800 \leqq \text{weft density} \times \sqrt{\text{weft yarn denier}} \leqq 900$.

3. A fabric as set forth in claim 1, wherein the ratio of a maximum width L1 to a minimum width L0 of a single warp appearing on the fabric surface is in the range of $2.0 \geqq L1/L0 \geqq 1.5$ .

4. A fabric as set forth in claim 1, wherein the warps and the wefts are each a polyester multifilament.

5. A fabric as set forth in claim 1, wherein the weft yarns are each a polyester finished yarn.

6. A fabric as set forth in claim 1 for use in dust proof clothes.

7. A fabric as set forth in claim 1 for use in waterproof clothes.

8. A fabric as set forth in claim 1 for use in dust proof and waterproof clothes.

9. A fabric as set forth in claim 2, where in the ratio of a maximum width L1 to a minimum width L0 of a single warp appearing on the fabric surface is in the range of $2.0 \geqq$ to $L1/L0 \geqq 1.5$.

10. A fabric as set forth in claim 2, where in the warps and the wefts are each a polyester multifilament.

11. A fabric as set forth in claim 3, where in the warps and the wefts are each a polyester multifilament.

12. A fabric as set forth in claim 2, wherein the weft yarns are each a polyester finished yarn.

13. A fabric as set forth in claim 3, wherein the weft yarns are each a polyester finished yarn.

14. A fabric as set forth in claim 4, wherein the weft yarns are each a polyester finished yarn.

15. A fabric as set forth in claim 2, for use in dust proof and waterproof clothes.

16. A fabric as set forth in claim 3, for use in dust proof and waterproof clothes.

17. A fabric as set forth in claim 4, for use in dust proof and waterproof clothes.

18. A fabric as set forth in claim 5, for use in dust proof and waterproof clothes.

19. A fabric as set forth in claim 2 for use in dust proof clothes.

20. A fabric as set forth in claim 2, for use in waterproof clothes.

* * * * *